US007047754B2

(12) United States Patent
An et al.

(10) Patent No.: US 7,047,754 B2
(45) Date of Patent: May 23, 2006

(54) HEATER CONTROLLER AND HEATER CONTROL METHOD OF REFRIGERATOR

(75) Inventors: Si-Yeon An, Gimhae (KR); Seong-Ook Kim, Chinju (KR); Oh-Chul Kwon, Changwon (KR); Bum-Sik Lee, Busan (KR); Dong-Yeol Yoo, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/948,696

(22) Filed: Sep. 24, 2004

(65) Prior Publication Data

US 2005/0072852 A1 Apr. 7, 2005

(30) Foreign Application Priority Data

Oct. 6, 2003 (KR) ..... 10-2003-0069368
Oct. 7, 2003 (KR) ..... 10-2003-0069709

(51) Int. Cl.
*F25D 21/06* (2006.01)

(52) U.S. Cl. ..... 62/150; 62/275; 62/389

(58) Field of Classification Search ..... 62/150, 62/151, 156, 272, 273, 275, 276, 389, 391, 62/396, 397, 176.2
See application file for complete search history.

(56) References Cited

U.S. PATENT DOCUMENTS 5,269,154 A * 12/1993 Schmidt ..... 62/275
5,442,933 A * 8/1995 Unger ..... 62/275
5,737,232 A * 4/1998 Wetekamp ..... 702/60
6,862,891 B1 * 3/2005 Devos ..... 62/80
6,889,517 B1 * 5/2005 Dehli ..... 62/275

* cited by examiner

*Primary Examiner*—Harry B. Tanner
(74) *Attorney, Agent, or Firm*—Fleshner & Kim LLP

(57) ABSTRACT

The present invention relates to a heater controller and a heater control method of a refrigerator, and more particularly, to a heater controller and a heater control method of a refrigerator, which control a heater mounted in a refrigerator dispenser. In the present invention, a dispenser of a refrigerator door is provided with a water tank. In order to prevent water in the water tank from being frozen over, the heater is mounted at an outside of the water tank. In addition, by measuring an outer surface temperature of the water tank and then recognizing a water temperature in the water tank based on the outer surface temperature of the water tank, the heater is controlled to be turned on/off based on a range of the water temperature in the water tank. Furthermore, in the present invention, an ambient temperature at a position of the refrigerator is measured, and then, the heater outputs heat energy according to a range of the ambient temperature. Then, the heat energy of the heater is transmitted to the water tank. As a result, the water temperature in the water tank is properly controlled, so that the water tank is prevented from being frozen over.

5 Claims, 4 Drawing Sheets

HEATER CONTROLLER AND HEATER CONTROL METHOD OF REFRIGERATOR

BACKGROUND OF THE INVENTION

1. Field of Invention

The present invention relates to a refrigerator, and more particularly, to a heater controller and heater control method of a refrigerator, which control a heater mounted in a refrigerator dispenser.

2. Description of the Prior Art

Recently, as the size of a refrigerator is increased, a refrigerator wherein water or ice can be taken out of the interior of the refrigerator without opening a door has been put on sale.

Such a refrigerator is configured so that a user can be supplied with the water through a dispenser formed on a front surface of a door of a freezing chamber without opening the refrigerator door. A supply route of the water with which the user is supplied from the dispenser is as follows. For example, a water supply pipe connected to a water supply source such as a faucet is provided. The water supply pipe passes through the interior of the refrigerator. Then, the water supplied through the water supply pipe is supplied to a water tank and then to the dispenser, so that the user can take out the water.

Hereinafter, a heater control method of a refrigerator according to the prior art will be described.

FIG. 1 is a view showing the interior of a refrigerator dispenser according to the prior art.

As shown in the figure, in the prior art, a water tank 70 for supplying water is connected to a water supply pipe (not shown) and provided in the interior of a dispenser 40. Thus, it is possible for a user to be always supplied with the water through the dispenser 40 without regard to time.

Further, in order to prevent an exterior of the dispenser 40 from being covered with dew, a heater 50 is mounted at a side of the water tank 70. The heater 50 is turned on/off at predetermined intervals previously set, as shown in FIG. 1, so that the heater 50 suppresses the dew from forming on the exterior of the dispenser 40. Here, the heater operates regardless of the condition of the water tank.

In addition, an amount of heat energy of the heater 50, which is so much that the exterior of the dispenser 40 is prevented from being covered with the dew, should be within the range in which a control of a temperature in the refrigerator and an ambient temperature of the refrigerator are not influenced.

In the prior art as described above, since the heater is simply turned on/off at predetermined intervals previously set, the heater operates regardless of the condition of the water tank. As a result, the heater operates even when the water temperature in the water tank is high, so that the water temperature is caused to increase more. Furthermore, in the prior art, in a case where the heater does not operate when the water temperature in the water tank is low, the water tank is frozen over. That is, in the conventional refrigerator, if when the water temperature in the water tank is sufficiently low, the heater does not operate and thus the water tank is kept at very low temperature, the interior of the water tank may be frozen over. As a result, since the water is not supplied from the water tank to the dispenser, the water cannot be taken out.

SUMMARY OF THE INVENTION

Accordingly, an object of the present invention is to provide a heater controller and a heater control method of a refrigerator, which control a heater in order not to freeze over water of a water tank in a dispenser.

According to the present invention for achieving the objects, there is provided a heater controller of a refrigerator. The refrigerator is provided with a dispenser connected to a water tank by means of a water supply pipe. The heater controller comprises: a heater mounted at a side of the water tank in order to generate heat; a first temperature sensor mounted on an outer surface of the water tank in order to sense an outer surface temperature of the water tank; a second temperature sensor for sensing an ambient temperature at a position of the refrigerator; and a microcontroller in which ranges of a water temperature in the water tank estimated based on the outer surface temperature of the water tank and the ambient temperature of the refrigerator are set, and which controls the heater to be turned on/off based on the water temperature in the water tank and the ambient temperature of the refrigerator.

Furthermore, according to the present invention for achieving the objects, there is provided a heater control method of a refrigerator. The refrigerator is provided with a dispenser connected to a water tank by means of a water supply pipe. The heater control method comprises: a first temperature sensing step for sensing an outer surface temperature of the water tank; a temperature estimation step for estimating a water temperature in the water tank based on the outer surface temperature of the water tank sensed in the first temperature sensing step; a heater control step for controlling a heater to be turned on/off by comparing the water temperature in the water tank estimated in the temperature estimation step with reference values; a second temperature sensing step for sensing an ambient temperature at a position of the refrigerator; a first heat energy output step for controlling the heater to be turned on/off at intervals of a first predetermined time if the ambient temperature sensed in the second temperature sensing step is over a predetermined temperature (E° C.); and a second heat energy output step for controlling the heater to be turned on/off so that the heater is turned on for a longer time than while the heater is turned off if the ambient temperature sensed in the second temperature sensing step is below a certain temperature (F° C.) (wherein E>F).

BRIEF DESCRIPTION OF THE DRAWINGS

The above and other objects, features and advantages of the present invention will become apparent from the following description of a preferred embodiment given in conjunction with the accompanying drawings, in which.

DETAILED DESCRIPTION OF THE PREFERRED EMBODIMENT

Hereinafter, a preferred embodiment of a heater controller and heater control method of a refrigerator according to the present invention will be described in detail with reference to the accompanying drawings.

Figure 1:
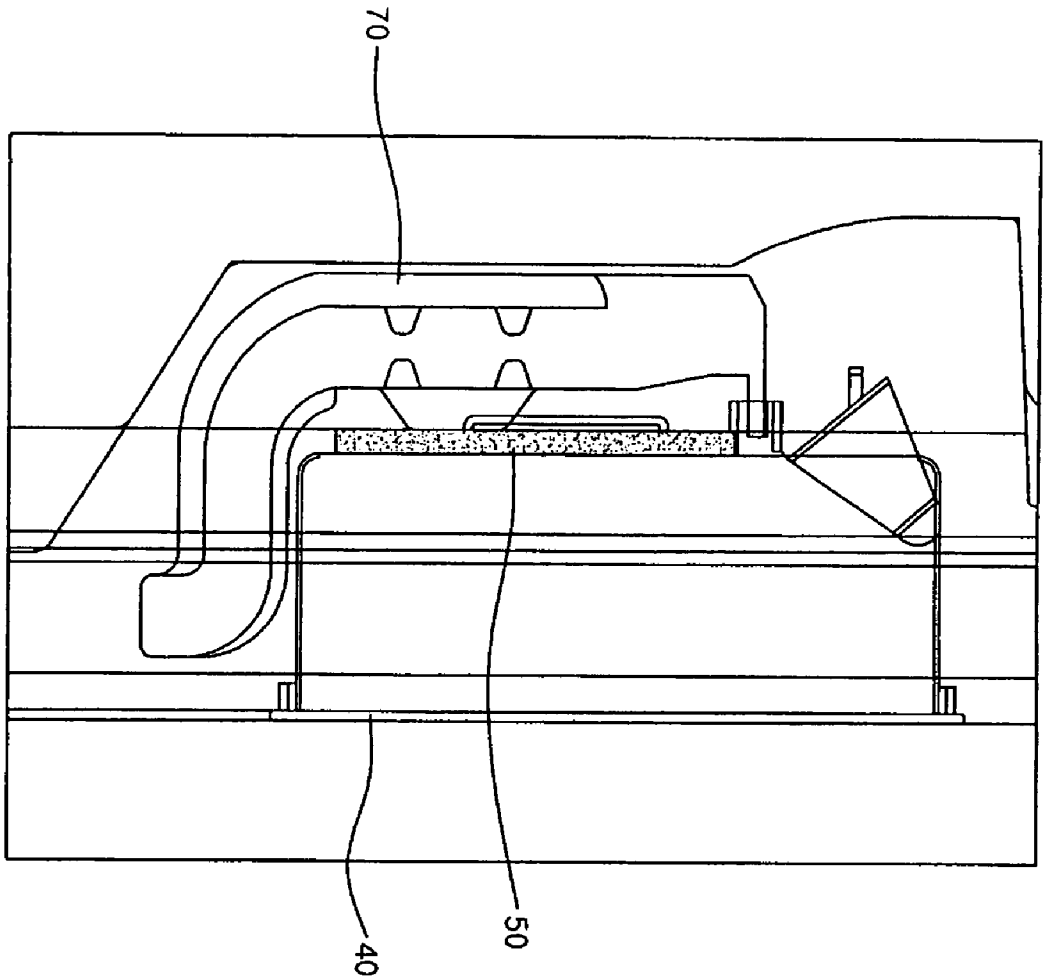
FIG. 1 PRIOR ART
FIG. 1 is a view showing the interior of a refrigerator dispenser according to a prior art.
Figure 2:
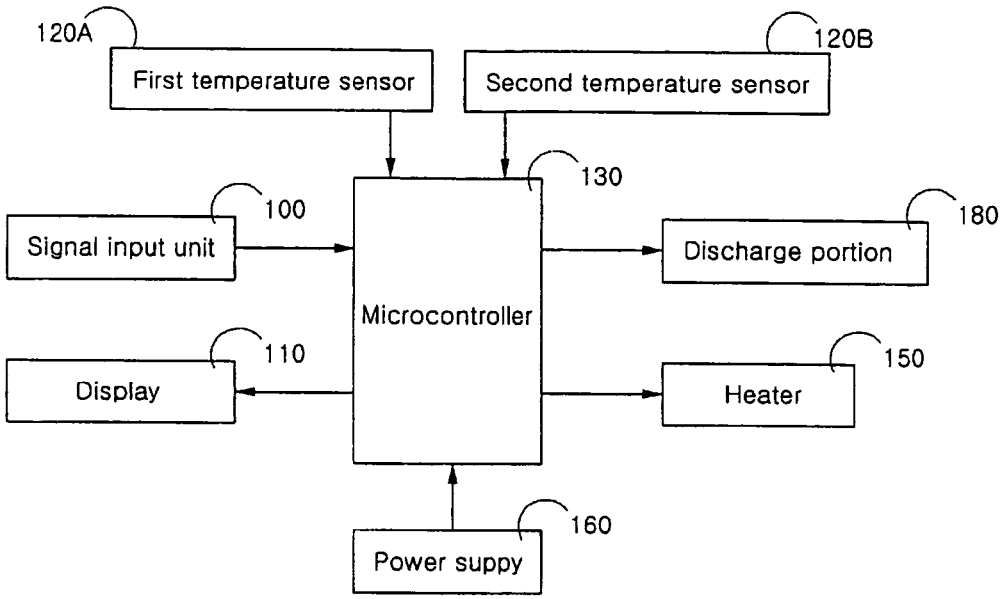
FIG. 2 is a view of the configuration for controlling a temperature of a water tank of a refrigerator dispenser according to the present invention.

FIG. 2 is a view of a configuration for controlling a temperature of a water tank of a refrigerator dispenser according to the present invention.

The control configuration of the present invention comprises a power supply 160 for supplying a refrigerator main body with power, a signal input unit 100 for inputting actuating signals (e.g., a temperature, operational functions, and the like), a display 110 for displaying the actuating signals to a user, a discharge portion 180 for discharging water, a heater 150 for heating the water tank, a first temperature sensor 120A for measuring an outer surface temperature of the water tank, a second temperature sensor 120B mounted on the outside of the refrigerator for measuring an ambient temperature of the refrigerator, and a microcontroller 130 for controlling the heater 150 based on the temperatures transmitted from the first and second temperature sensors 120A and 120B.

The outer surface temperature of the water tank sensed through the first temperature sensor 120A is transmitted to the microcontroller. Then, the microcontroller 130 recognizes a temperature in the water tank based on the transmitted outer surface temperature of the water tank. Next, the microcontroller 130 compares the water temperature in the water tank with a previously set temperature range, and determines whether or not the heater is allowed to operate based on the temperature in the water tank. Thus, based on the determination for the comparison in the microcontroller 130, the heater 150 is turned on if it is determined that the heater 150 should operate, while the heater 150 is turned off if it is determined that the heater 150 need not operate.

In the meantime, the ambient temperature sensed through the second temperature sensor 120B is transmitted to the microcontroller 130. Then, the microcontroller 130 compares the ambient temperature of the refrigerator with a previously set temperature range, and determines how to output the heat energy from the heater based on the ambient temperature of the refrigerator. Therefore, based on the determination in the microcontroller 130, if the ambient temperature of the refrigerator is over a predetermined temperature, the heater 150 is controlled to be turned on/off in a first heating output mode. If the ambient temperature of the refrigerator is below a certain temperature, the heater 150 is controlled to be turned on/off in a second heating output mode.

In the first heating output mode, the heater 150 is controlled so that the heater 150 is turned on/off at the same intervals (for example, the heater 150 is turned on for 30 minutes and off for 30 minutes in the embodiment of the present invention). In the second heating output mode, the heater 150 is turned on for a longer time than while the heater 150 is turned off (for example, the heater 150 is turned on for 50 minutes and off for 10 minutes in the embodiment of the present invention).

Figure 3:
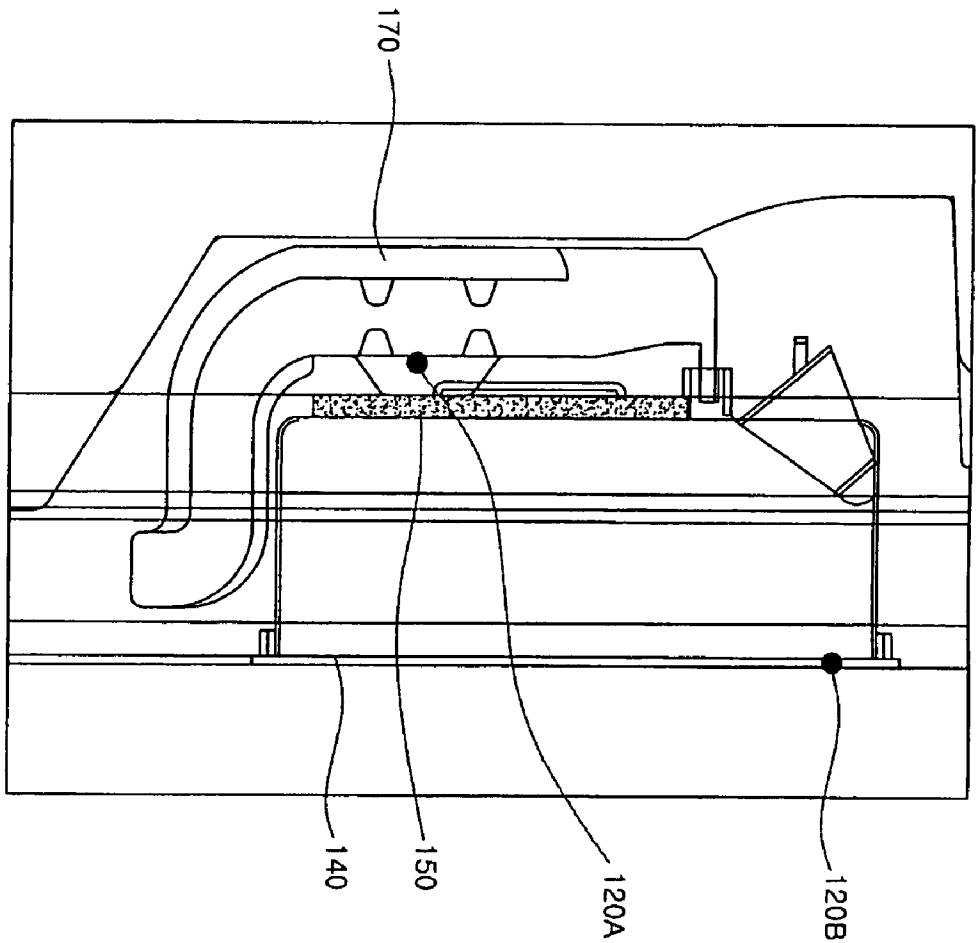
FIG. 3 is a view showing the interior of the refrigerator dispenser according to the present invention.

FIG. 3 is a view showing an interior of the refrigerator dispenser according to the present invention.

In FIG. 3, a dispenser 140 of the refrigerator, through which the water is taken out, is shown. As shown in FIG. 3, the water tank 170 for supplying the water is provided in the dispenser. A water supply pipe from the water tank is connected to a water discharge port (not shown). Accordingly, it is possible for the user to always take out the water through the water discharge port (not shown) provided in the dispenser 140 without regard to time.

In the meantime, the outer surface of the water tank 170 is mounted with the first temperature sensor 120A in order to sense the water temperature of the water tank 170. In addition, the refrigerator is provided with the second temperature sensor 120B for measuring the ambient temperature at a position where the refrigerator is installed. Furthermore, in order to prevent the exterior of the dispenser 140 from being covered with dew and to keep the water temperature in the water tank 170 to be constant, as shown in FIG. 3, a side of the water tank 170 is mounted with the heater 150.

The heater 150 is controlled to be turned off when the water temperature in the water tank 170 is over a predetermined temperature, while the heater 150 is controlled to be turned on when the water temperature in the water tank 170 is below a certain temperature.

Furthermore, based on the temperature sensed from the second temperature sensor 120B mounted to the refrigerator, the heater 150 is controlled to be turned off if the ambient temperature of the refrigerator is over the predetermined temperature, while the heater 150 is controlled to be turned on if the ambient temperature of the refrigerator is below the certain temperature.

Here, an amount of heat energy of the heater 150, which is so much that the exterior of the dispenser 140 is prevented from being covered with the dew and the water temperature in the water tank is constantly kept, should be within the range in which the ambient temperature of the refrigerator and the temperature in the refrigerator are not influenced.

In the meantime, if the water tank 170 is kept at a very low temperature through the heater control based on the ambient temperature and the temperature in the refrigerator, the water in the water tank 170 may be frozen over. As a result, since the water does not supplied from the water tank 170 to the dispenser 140, the circumstances that the water cannot be taken out may occur. In order to prevent such circumstances, in the present invention, the heater 150 is controlled based on the water temperature in the water tank 170, so that the water temperature in the water tank 170 is kept at an optimal condition. That is, the water tank is prevented from being frozen over by measuring the outer surface temperature of the water tank and the ambient temperature of the refrigerator and controlling the heater mounted to the outside of the water tank.

Hereinafter, a process for controlling the heater by measuring the outer surface temperature of the water tank will be described below.

The first temperature sensor 120A mounted on the outer surface of the water tank 170 senses the temperature, and then, the sensed temperature is transmitted to the microcontroller 130. The microcontroller 130 determines the condition in the water tank 170 based on the transmitted temperature, and thus, controls the heater 150.

At this time, since the temperatures in the water tank 170 estimated based on the outer surface temperatures of the water tank are set in the microcontroller 130, the microcontroller 130 can recognize the temperature in the water tank 170 based on the outer surface temperature of the water tank 170 transmitted from the first temperature sensor 120A.

Thus, if the water temperature in the water tank 170 estimated based on the outer surface temperature of the water tank 170 measured from the first temperature sensor 120A is over the predetermined temperature (e.g., 7° C. in the embodiment of the present invention), the microcontroller 130 controls the heater 150 to be turned off. In addition, if the water temperature in the water tank estimated based on the outer surface temperature of the water tank 170 measured from the first temperature sensor 120A is below the certain temperature (e.g., 3° C. in the embodiment of the present invention), the microcontroller 130 controls the heater 150 to be turned on.

In the meantime, a process for controlling the heater based on the measurement of the ambient temperature of the refrigerator will be described as follows.

The second temperature sensor 120B mounted on the outside of the refrigerator senses the ambient temperature, and then, the sensed ambient temperature is transmitted to the microcontroller 130. If the ambient temperature of the refrigerator measured from the second temperature sensor 120B is over the predetermined temperature, the microcontroller 130 controls the heater 150 to be turned on/off in the first heating output mode (e.g., the heater 150 is turned on for 30 minutes and off for 30 minutes in the embodiment of the present invention).

Also, if the ambient temperature of the refrigerator measured from the second temperature sensor 120B is below the certain temperature, the microcontroller 130 controls the heater 150 to be turned on/off in the second heating output mode (e.g., the heater 150 is turned on for 50 minutes and off for 10 minutes in the embodiment of the present invention).

The operation for controlling the heater by measuring the outer surface temperature of the water tank and the ambient temperature of the refrigerator will be described as follows.

Figure 4:
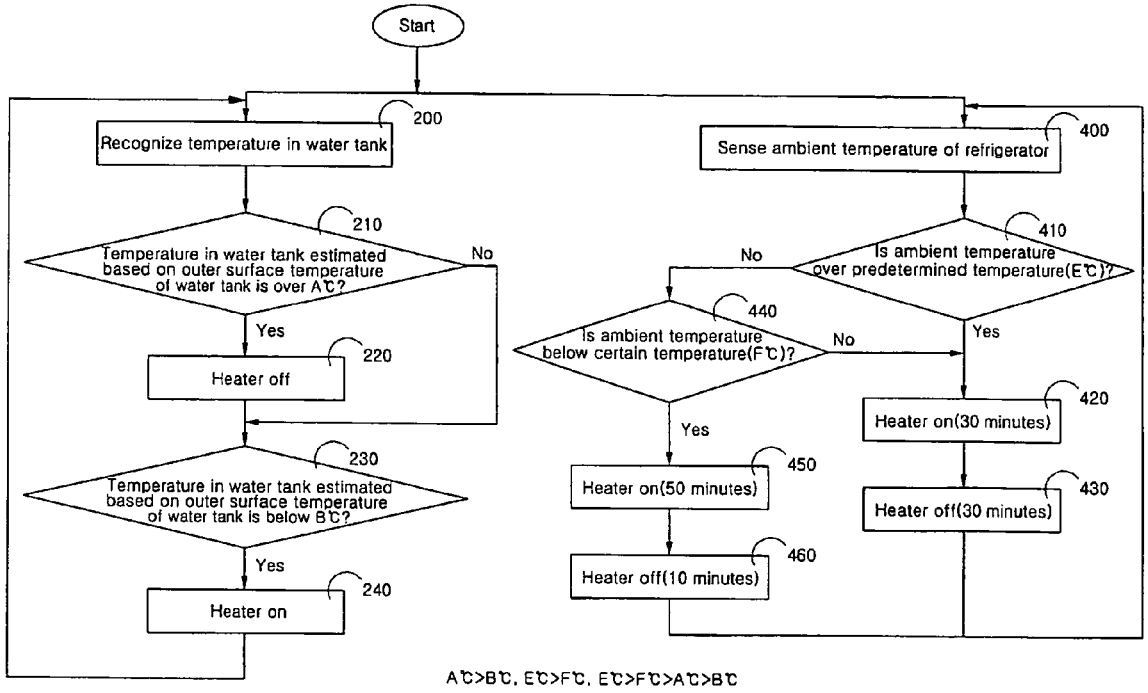
FIG. 4 is a flowchart illustrating a process of controlling a heater in order to control the temperature of the water tank of the refrigerator dispenser according to the present invention.

FIG. 4 is a control flow chart for controlling the heater in order to control the temperature of the water tank of the refrigerator dispenser according to the present invention.

If the refrigerator is supplied with the power, a cooling cycle operates, so that the interior of the refrigerator is supplied with cool air. The interior of the refrigerator is supplied with cool air, and simultaneously, the water in the water tank 170 is supplied to the discharge portion 180 of the dispenser 140 through the water supply pipe. Accordingly, the user can always be supplied with the water through the discharge portion 180 of the dispenser 140 without regard to time.

At this time, in order to allow the water in the water tank 170 to be kept at an optimal condition while the water is not frozen over, the present invention first recognizes the condition of the water temperature in the water tank 170 by mounting the first temperature sensor 120A on the outer surface of the water tank 170 and sensing the outer surface temperature of the water tank.

Second, the present invention measures the ambient temperature of the refrigerator by mounting the second temperature sensor 120B on the outside of the refrigerator, and properly controls the heater based on the ambient temperature.

First of all, a method for controlling the heater based on the outer surface temperature of the water tank 170 will be described as follows.

The outer surface temperature of the water tank 170 is measured through the first temperature sensor 120A mounted on the outer surface of the water tank 170. The outer surface temperature of the water tank measured from the first temperature sensor 120A is transmitted to the microcontroller 130, and then, the microcontroller 130 recognizes the water temperature in the water tank 170 from the transmitted outer surface temperature of the water tank 170 (step 200). Then, the microcontroller 130 controls the heater 150 based on the water temperature in the water tank 170.

That is, if it is determined that the water temperature in the water tank 170 is over the predetermined temperature (A° C.) (step 210), the microcontroller 130 turns off the heater 150 provided at the outside of the water tank 170 (step 220). Accordingly, it is prevented that the water temperature of the water tank 170 increases by the heat generated from the heater 150.

However, if the water temperature in the water tank 170 is below the certain temperature (B° C.) (step 230), the microcontroller 130 determines that the water tank 170 can be frozen over since the temperature in the water tank 170 is very low. Accordingly, the microcontroller 130 controls the heater 150 provided at the outside of the water tank 170 to be turned on, so that the heat energy of the heater 150 is transmitted to the water tank 170 (step 240). Thus, it is prevented that the water in the water tank 170 is frozen over since the temperature in the water tank 170 lowers.

Next, a method for controlling the heater based on the ambient temperature of the refrigerator main body will be described below.

First, the ambient temperature at the position of the refrigerator is measured through the second temperature sensor 120B provided on the outside of the refrigerator (step 400). The temperature measured through the second temperature sensor 120B is transmitted to the microcontroller 130, and the microcontroller 130 controls the heater 150 based on the transmitted temperature.

That is, if the ambient temperature of the refrigerator is over the predetermined temperature (E° C.) (step 410), the microcontroller 130 determines that the dispenser is covered with the dew, and performs an algorithm for preventing the dew from forming. To this end, the microcontroller controls the heater to be turned on/off in the first heating output mode in the dew forming prevention algorithm. Here, the first heating output mode is defined as a mode in which the heater 150 is turned on/off with the same output at the same intervals of a first predetermined time. In the embodiment of the present invention, the predetermined temperature (E° C.) and the first predetermined time are set to about 25° C. and 30 minutes, respectively, and then, the heater is controlled to be turned on/off at intervals of 30 minutes.

Therefore, the heater 150 is turned on for the first predetermined time, and then, turned off for the first predetermined time. That is, after the heater 150 is turned on for 30 minutes (step 420), the heater 150 is turned off for 30 minutes (step 430). Accordingly, the water temperature of the water tank 170 is prevented from increasing higher than a reasonable value.

In the meantime, if the ambient temperature of the refrigerator is not over the predetermined temperature (E° C.) in step 410, the microcontroller 130 determines whether or not the ambient temperature of the refrigerator sensed through the second temperature sensor 120B is below the certain temperature (F° C.) (step 440). As a result thereof, if the ambient temperature of the refrigerator is not below the certain temperature (F° C.), step 420 for the dew prevention algorithm is performed, so that the heater 150 is turned on for the first predetermined time (step 420), and then, turned off for the first predetermined time (step 430).

However, if in step 440, the ambient temperature of the refrigerator is below the certain temperature (F° C.), the microcontroller 130 determines that the water tank 170 may be frozen over since the temperature in the water tank 170 is very low. Then, the microcontroller 130 controls the heater 150 in order to perform a control algorithm for preventing the interior of the water tank from being frozen over. Accordingly, the heater 150 is controlled to operate in the second heating output mode; Here, the second heating output mode is defined as a mode in which the heater 150 is turned on for a longer time than while it is turned off. That is, after the heater 150 is turned on for a first certain time, the heater 150 is turned off for a second certain time. For example, if the heater 150 is turned on for 50 minutes (i.e., the first certain time) (step 450), the heater 150 is turned off for the 10 minutes (i.e., the second certain time) (step 460). Accordingly, since the heater 150 is controlled, it is prevented that the water tank 170 is frozen over due to the lowered temperature in the water tank 170.

At this time, the ambient temperature which is compared and determined to control the heater 150 is based on experimental values. That is, the ambient temperature according to a time point at which the interior of the water tank 150 is about to be frozen over is set to the reference temperature for controlling the heater 150. In the embodiment of present invention, the certain temperature (F° C.) is set to about 10° C. or less. Then, the present invention determines that the certain temperature (F° C.) of 10° C. is a condition where the freezing occurs.

In addition, the amount of the heat energy of the heater 150 is set within a range output at a minimum temperature to prevent the dispenser 140 from being covered with the dew and the water tank 170 from being frozen over. Thus, the amount of the heat energy of the heater 150 is set within a range not to affect the ambient temperature of the refrigerator and the temperature in the refrigerator, and set based on experimental values.

According to the heater controller and the heater control method of the present invention, the following advantages can be expected.

The present invention measures the outer surface temperature of the water tank through the first temperature sensor, and controls the heater by recognizing the water temperature in the water tank based on the measured outer surface temperature of the water tank. Thus, it is possible to keep the optimal condition of the water temperature in the water tank and to prevent the interior of the water tank from being frozen over.

In addition, the present invention measures the ambient temperature at the position of the refrigerator through the second temperature sensor, and controls the heater to operate based on the range of the measured temperature. As a result, it is possible to prevent the dispenser from being covered with the dew and to keep the optimal condition of the temperature in the water tank. Accordingly, the interior of the water tank is prevented from being frozen over, so that the user can always easily take out the water.

As described above, the present invention has the technical features in that in order for the water in the water tank for storing the water not to be frozen over for supplying the user with the water from the discharge portion of the dispenser, the heater is controlled to heat the water tank by recognizing the water temperature based on the outer surface temperature of the water tank, or the heater is controlled based on the range of the ambient temperature at the position of the refrigerator.

It will be apparent that those skilled in the art can make various modifications and changes thereto within the scope without departing from the technical spirit of the invention. Therefore, the scope of the present invention is not limited to the embodiment described and illustrated above but is defined by the appended claims.

What is claimed is:

1. A heater controller of a refrigerator, wherein the refrigerator is provided with a dispenser connected to a water tank by means of a water supply pipe, comprising:

a heater mounted at a side of the water tank in order to generate heat;

a first temperature sensor mounted on an outer surface of the water tank in order to sense an outer surface temperature of the water tank;

a second temperature sensor for sensing an ambient temperature at a position of the refrigerator; and a microcontroller in which ranges of a water temperature in the water tank estimated based on the outer surface temperature of the water tank and the ambient temperature of the refrigerator are set, the microcontroller controlling the heater to be turned on/off based on the water temperature in the water tank and the ambient temperature of the refrigerator.

2. A heater control method of a refrigerator, wherein the refrigerator is provided with a dispenser connected to a water tank by means of a water supply pipe, comprising:

a first temperature sensing step for sensing an outer surface temperature of the water tank;

a temperature estimation step for estimating a water temperature in the water tank based on the outer surface temperature of the water tank sensed in the first temperature sensing step;

a heater control step for controlling a heater to be turned on/off by comparing the water temperature in the water tank estimated in the temperature estimation step with reference values;

a second temperature sensing step for sensing an ambient temperature at a position of the refrigerator;

a first heat energy output step for controlling the heater to be turned on/off at intervals of a first predetermined time if the ambient temperature sensed in the second temperature sensing step is over a predetermined temperature (E° C.); and a second heat energy output step for controlling the heater to be turned on/off so that the heater is turned on for a longer time than while the heater is turned off if the ambient temperature sensed in the second temperature sensing step is below a certain temperature (F° C.), wherein E>F.

3. The method as claimed in claim 2, wherein in the first heat energy output step, the predetermined temperature (E° C.) is about 25° C., and the heater is turned on/off at the intervals of the first predetermined time of 30 minutes.

4. The method as claimed in claim 2, wherein in the second heat energy output step, the certain temperature (F° C.) is about 10° C., and the heater is controlled to be turned on for 50 minutes and turned off for 10 minutes.

5. The method as claimed in claim 2, wherein in the heater control step, the reference value for turning off the heater is 7° C., and the reference value for turning on the heater is 3° C.

* * * * *